United States Patent [19]

Lewis et al.

[11] 4,323,292

[45] Apr. 6, 1982

[54] HIGH VOLTAGE SLIP RING ASSEMBLY

[75] Inventors: Norris E. Lewis, Christiansburg; Herbert C. Walker, Blacksburg, both of Va.

[73] Assignee: Litton Systems, Inc., Blacksburg, Va.

[21] Appl. No.: 148,707

[22] Filed: May 12, 1980

[51] Int. Cl.[3] ..... H01R 39/00

[52] U.S. Cl. ..... 339/5 M; 339/5 P

[58] Field of Search ..... 339/5, 6, 8

[56] References Cited

U.S. PATENT DOCUMENTS 2,931,999 4/1960 Lemmerman .

3,316,519 4/1967 Maytone ..... 339/5

4,063,792 12/1977 Lodge ..... 339/5 L 4,201,430 5/1980 Dinwiddie et al. ..... 339/5

*Primary Examiner*—Joseph H. McGlynn

*Assistant Examiner*—Frank H. McKenzie, Jr.

*Attorney, Agent, or Firm*—Brian L. Ribando

[57] ABSTRACT

A slip ring for use in a high voltage system, such as a computerized axial tomography system, capable of coupling power in a 100–200 KV range at speeds up to 200 rpm, including the combined use of insulating fluid, dielectric barriers, Faraday shielding and semi-conductive material to maintain the electrical integrity of the slip ring.

10 Claims, 5 Drawing Figures

HIGH VOLTAGE SLIP RING ASSEMBLY

The invention relates to a slip ring assembly for use in a high voltage system, such as a computerized axial tomography system, wherein the slip ring assembly provides the means to transfer power to an orbiting X-ray tube.

In computerized axial tomography scanning systems, an X-ray tube is orbited around a patient and generated data is processed by a computer to yield an X-ray display depicting a desired cross-sectional view of the patient.

The X-ray tube typically requires 150,000 volts in order to operate. This voltage is supplied via a cable connected to the X-ray tube. As the X-ray tube orbits around the body of a patient, the cable winds thereabout. The X-ray tube orbiting must, accordingly, be stopped after about one rotation and reversed. It would be highly advantageous to overcome this limitation and be able to orbit an X-ray tube continuously about a patient.

It is, therefore, an object of the invention to provide a slip ring assembly operable at voltages within a 100,000 to 200,000 volt range with a rotational speed up to 200 rpm, and in particular, to provide a slip ring assembly to supply high voltage to an X-ray tube which is used in a computerized axial tomography system.

Other objects and advantages of the present invention will become apparent from the following detailed description of the invention taken in conjunction with the accompanying drawings.

Referring to the drawings.

Figure 1:
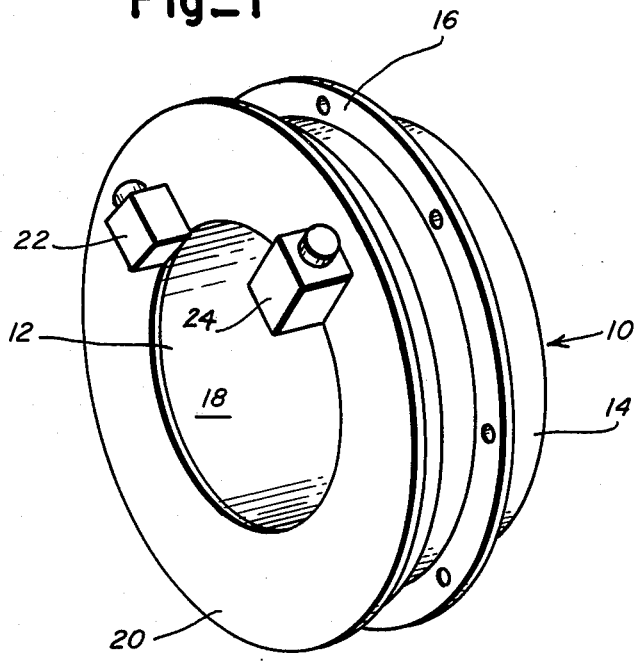
FIG. 1 is a perspective view of a high voltage slip ring assembly.

As can be seen in FIG. 1, the high voltage slip ring assembly 10 is generally doughnut-shaped having a central bore 12 which is large enough to accommodate an object to be scanned such as a human patient. A stationary cylinder 14, including a mounting ring 16, may be mounted to a suitable support structure (not shown) and provides a means for supporting a rotating structure 18. The rotating structure 18 includes an end mounting plate 20 for supporting an orbiting X-ray tube or other device (not shown) which may be suitably connected to anode and cathode junction boxes 22 and 24 provided thereon. The junction boxes are suitably radially spaced to prevent arcing between the anode and cathode.

Figure 2:
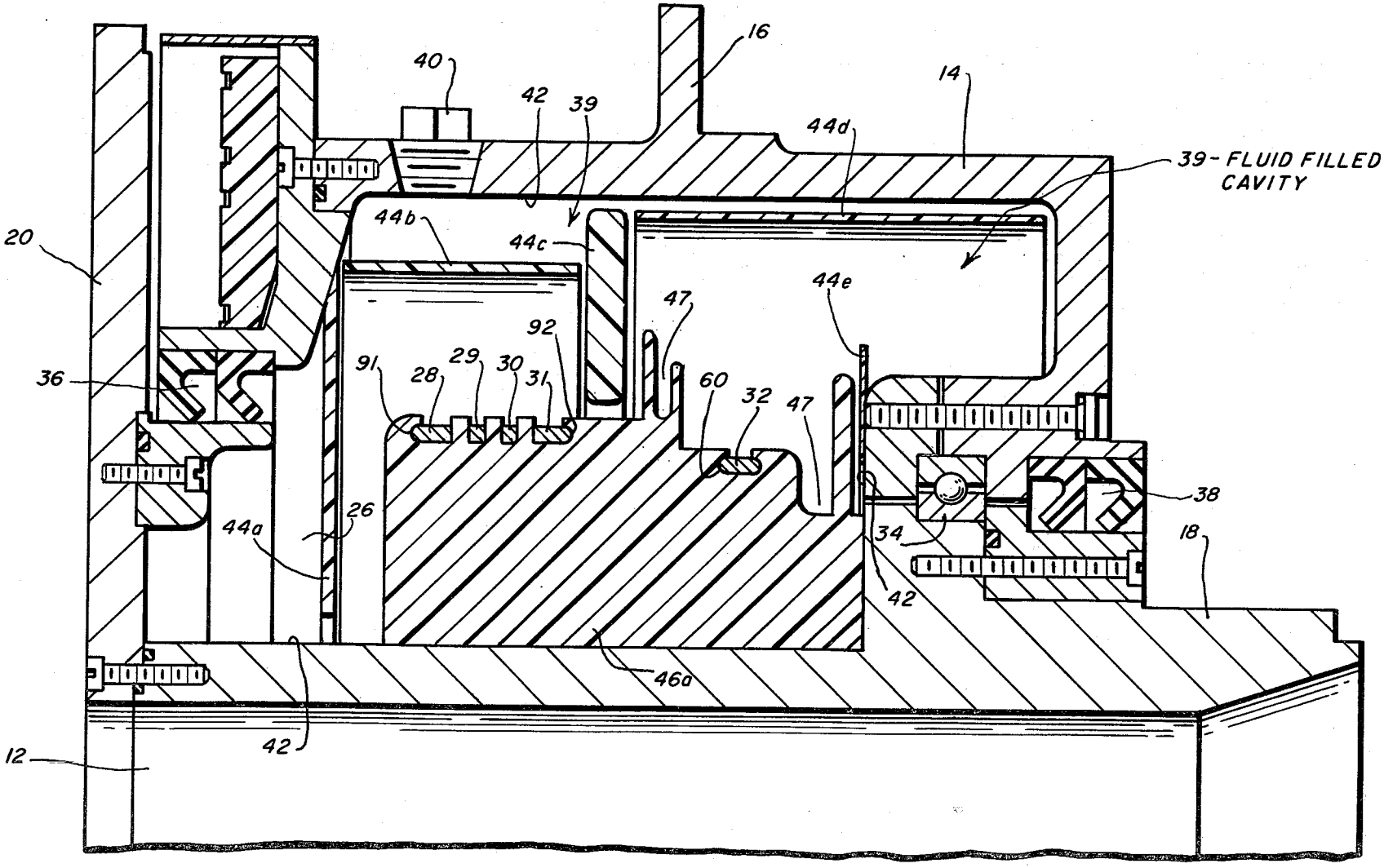
FIG. 2 is a sectional view of the top radial portion of the slip ring assembly.

Turning now to FIG. 2, it will be seen that the space between the stationary structure or stator 14 and the rotating structure or rotor 18 defines a cavity 26 in which slip rings 28, 29, 30, 31, and 32 are housed. In operation, the anode ring 32 carries a positive potential in the 50–100 KV range. The cathode rings 28, 29, 30 and 31 carry negative potentials in the 50–100 KV range, and the conductive cavity walls 42 remain at ground potential.

The rotor 18 is mounted to the stator 14 on a single bearing ring 34 for rotational movement. Pairs of annular lip-like seals 36 and 38 are used at the interface of the rotor and stator to operatively seal the cavity 26. An inlet with a plug 40 is provided on the top of the assembly for filling the cavity with an insulating fluid, such as insulating oil 39, having a dielectric strength substantially greater than the dielectric strength of air. Such insulating oil is commercially sold under the name UNIVOLT®. If an insulating gas were used, a valve would be substituted for the plug 40. Insulating gases are further discussed in a U.S. patent application filed by coinventor, Norris E. Lewis, of this application concurrently herewith.

The insulating fluid 39 permits the assembly to be dimensioned smaller than would be possible if air were used as the dielectric medium in the cavity. Without the fluid, short circuiting or arcing would occur during usage.

The use of the insulating fluid, however, introduces other problems. The fluid contains inherent impurities, such as particulates, fibers and polar chemical species, and other particulate matter is abraided during operation of the assembly from the brushes, the slip rings, the rubber seals, and the supporting bearings. It is known that these particulates in the fluid, responding to the high operational potential differences, create particulate bridges or breakdown paths which cause short circuiting or arcing along sight lines between components which are at different potentials.

Figure 3:
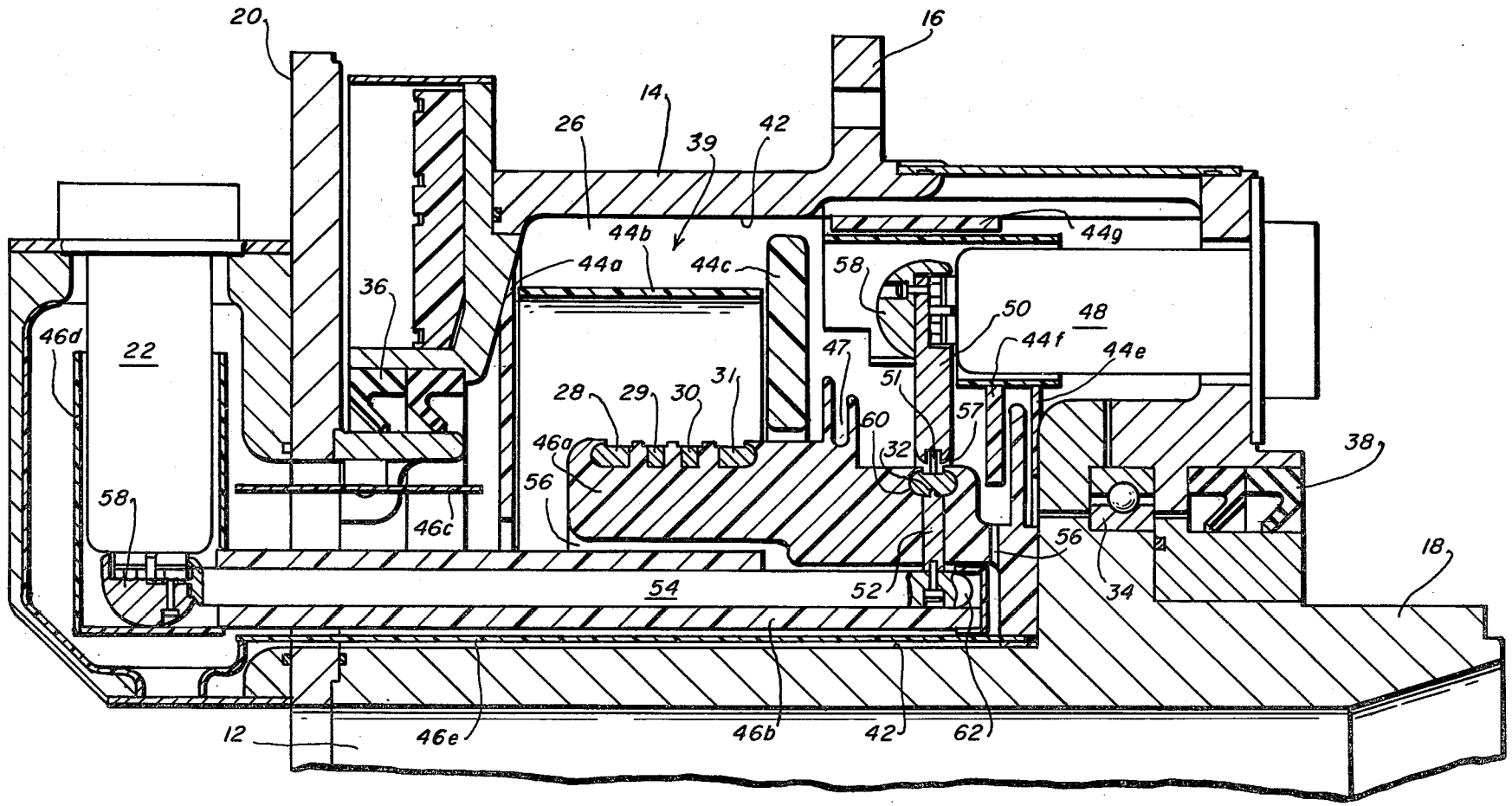
FIG. 3 is a sectional view of a radial portion of the slip ring assembly showing the anode coupling path in radial alignment.
Figure 5:
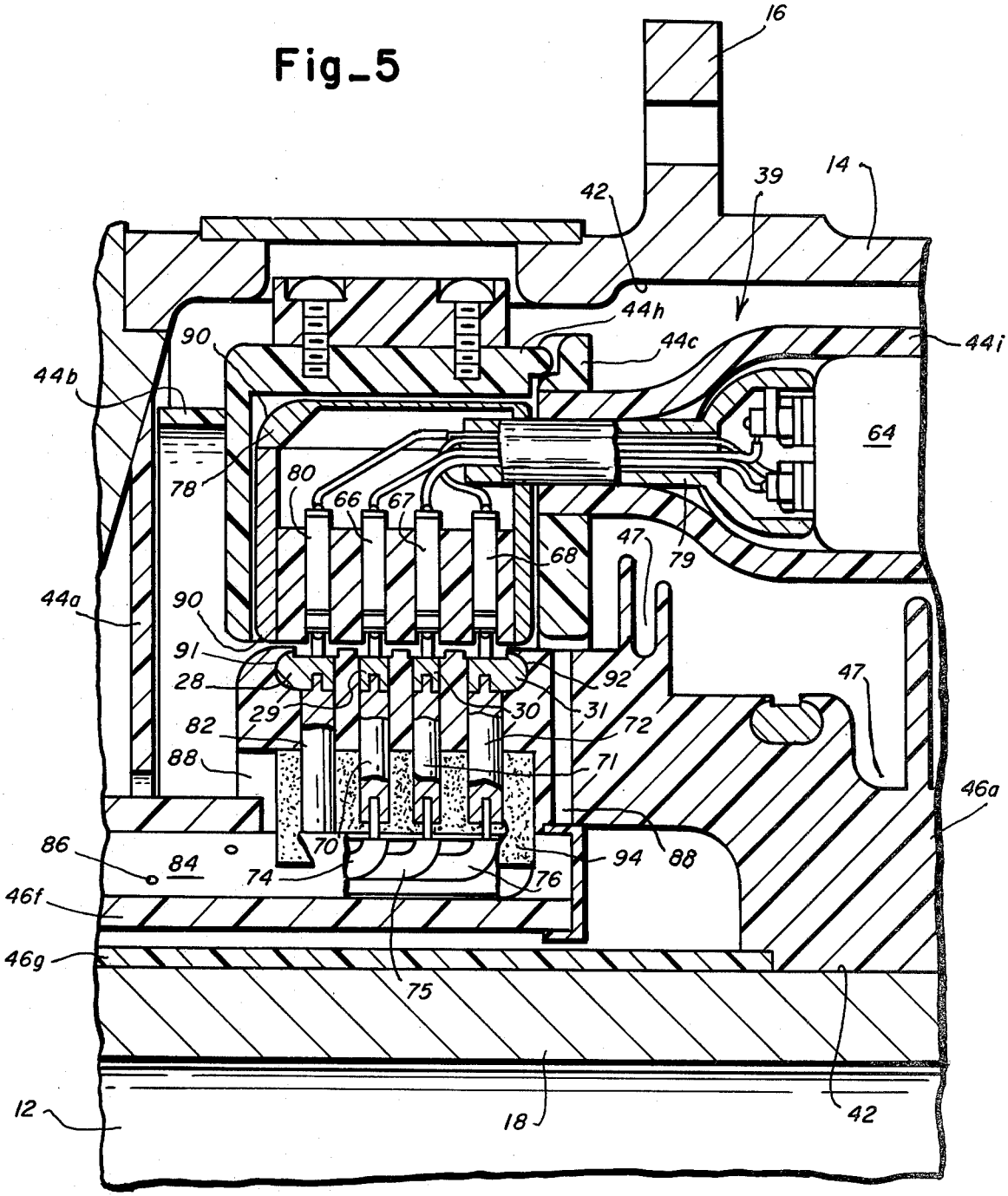
FIG. 5 is a sectional view of a radial portion of the slip ring assembly showing a portion of the cathode coupling path in radial alignment.

In order to prevent the formation of particulate bridges in the slip ring assembly, stationary and rotating dielectric barriers 44*a–i* and 46*a–g*, as shown in FIGS. 2, 3 and 5, are mounted within the cavity on the stator and rotor, respectively, blocking all line or sight paths between conductive elements, 32, 28–31 and 42 which are at substantially different potentials during operation. The barrier 46*a* on the rotating structure additionally provides a dielectric mounting base for the slip rings. As can be seen in FIGS. 3 and 5, the barriers 44*a–i* and 46*a–g* extend to block line of sight bridging paths in the cavity between the cavity walls 42 and the entire anode and cathode coupling paths.

In the preferred embodiment, the barriers 44*a–i* and 46*a–g* are composed of a dielectric material having a dielectric constant which closely matches that of the insulating fluid 39. The matching dielectric properties prevent arcing along the interface of insulating materials 39, 44*a–i* and 46*a–g*. Also, selectively grooved portions 47 in the barrier 46*a* provide a relative long voltage surface creepage path between the cavity wall 42 and the anode ring 32 and between the anode ring 32 and the cathode rings 28–31. Where practical, the barriers are constructed to tightly fit around conductive components, such as where the tubular barrier 46*b* encases the bus bar 54. This helps to prevent the formation of air bubbles within the cavity when it is filled with the insulating fluid.

As can be seen in FIG. 3, the anode coupling path couples a single positive potential from a stationary anode receptacle 48 to the rotating anode junction box 22. A single brush block assembly 50 extends from the anode receptacle 48 and includes four brushes 51 which make sliding electrical contact with the anode slip ring 32 which, in turn, is electrically coupled to the junction box by a cylindrical stud 52 and a cylindrical bus bar 54.

Selectively defined apertures 56 in the dielectric barrier 46a allow the dielectric oil to surround a portion of the bus bar 54.

Figure 4:
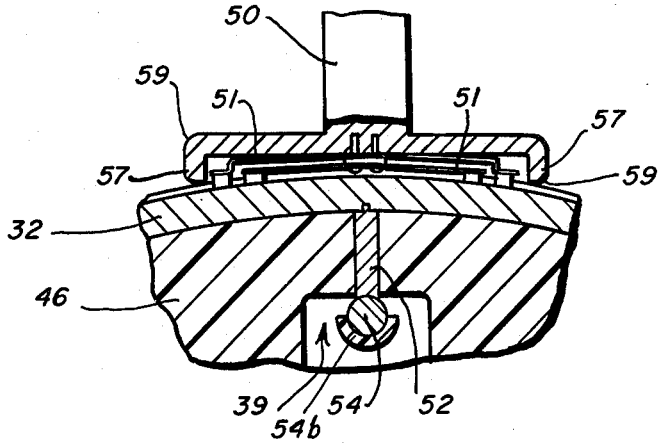
FIG. 4 is a sectional view of the anode brush block assembly with brushes in contact with the anode ring.

In order to reduce the possibility of arcing which is inherent in high voltage systems, Faraday shielding is employed around the brushes 51. As can be seen in FIG. 4, this Faraday shielding comprises the extended portions 57 of the brush block assembly 50 which surrounds the brushes 51 to distribute charge over the shield. Semi-spherical caps 58 which surround the junctions of the anode coupling path with the anode receptacle 48 and junction box 22, the roundness of the stud 52, rounded brush block assembly portions 59, rounded ring edges 60, and roundness of bus bar 54 including rounded end 62 additionally help to prevent charge build-up which would otherwise occur at sharp corners and which would be prime sources of unwanted arcing.

As can be seen in FIG. 5, the cathode coupling path couples a plurality of negative potentials from a stationary cathode receptacle 64 to the cathode junction box 24. Four brush assemblies 66, 67, 68 and 80, including leads extending from the cathode receptacle 64, are in sliding electrical contact with respective slip rings 29, 30, 31 and 28. The four brush assemblies 66, 67, 68 and 80 are encased in a housing 78 and a cylindrical member 79 which are electrically coupled to the fourth brush assembly 80 to provide Faraday shielding for the entire cathode brush block. The barrier 44h extends to surround the Faraday shield housing 78. Three of the rings 29, 30 and 31 are coupled to the junction box 24 by connecting studs 70, 71 and 72 and cables 74, 75 and 76, respectively. The fourth ring 28 is coupled by a connecting stud 82 to a tube 84 surrounding the cathode cables 74, 75 and 76 which, in turn, is connected to the cathode junction box 24. The tube serves both as a conductive circuit element and as a Faraday shield for the cables 74, 75 and 76. Both the tube 84 and the dielectric barrier 46a contain apertures 86 and 88 to allow the oil to seep in among the cables 74, 75 and 76.

Rounded exterior corners and edges of the Faraday shield housing 90, roundness of the connecting studs 70, 71, 72 and 82, a rounded outside edge 91 and 92 on each of the end rings 28 and 31, and the relatively large radii of both the cylindrical member 79 and the tube 84 help to reduce the possibility of arcing along the cathode coupling path through charge distribution. The studs 70, 71, 72 and 82, which are not fully shielded, are partially encased in a semi-conductive material 94 which, similar to a Faraday shield, prevents arcing by preventing charge build-up. The semi-conductive material 94 conducts sufficiently to distribute charges over its relatively large surface area while permitting the various negative potentials carried by the studs to remain distinct. Without the semi-conductive material 94, charge build-up could occur at the narrow junctions between the studs 70, 71 and 72 and cables 74, 75 and 76 which could cause arcing.

Any number of circuits could be coupled using the principles embodied in the construction of the cathode coupling path as shown in FIG. 5. However, if only a single negative potential were to be coupled, the cathode coupling path could be structured similar to the anode path without the semi-conductive material.

What is claimed is:

1. A high voltage slip ring assembly adapted to be filled with an insulating fluid comprising:

a rotor and a stator for defining a cavity therebetween, seal means for operatively sealing said cavity for retaining the insulating fluid therein, said rotor and said stator being at ground potential, anode coupling means within said cavity, cathode coupling means within said cavity, said anode and cathode coupling means each including Faraday shielding means, and dielectric barrier means within said cavity for blocking line of sight particulate paths, when the slip ring assembly is transferring power, between said anode means and said cathode means, between said anode means and said rotor and stator, and between said cathode means and said rotor and stator, whereby operational short circuiting and arcing within said cavity is prevented.

2. A high voltage slip ring assembly adapted to be filled with an insulating fluid comprising:

a stator, a rotor rotatably mounted to said stator defining a cavity therebetween, seal means operatively sealing said cavity for retaining the insulating fluid therein, said rotor including an end mounting plate having an anode junction box and cathode junction box selectively positioned thereon, said stator including an anode receptacle and a cathode receptacle, said cavity having wall portions being at ground potential, anode coupling means for coupling a positive potential from said anode receptacle through said cavity to said anode junction box, cathode coupling means for coupling a negative potential from said cathode receptacle through said cavity to said cathode junction box, said anode and cathode coupling means each including Faraday shielding means, and dielectric barrier means within said cavity for blocking line of sight particulate paths between the conductive parts which are at different potentials when the slip ring assembly is transferring power, whereby, when said cavity is filled with the insulating fluid, the electrical integrity of the slip ring assembly is maintained.

3. A high voltage slip ring assembly according to claim 2, wherein, said anode coupling means comprises an anode conductive ring mounted in said cavity on said rotor, anode conductor means for electrically coupling said anode ring to said anode junction box, and an anode brush block assembly extending from said anode receptacle into said cavity including brush means for sliding electrical contact with said anode ring and including Faraday shielding means surrounding said brush means, and said cathode coupling means comprises a cathode conductive ring mounted in said cavity on said rotor, cathode conductor means for electrically coupling said cathode ring to said cathode junction box, and a cathode brush block assembly extending from said cathode receptacle into said cavity including brush means for sliding electrical contact with said cathode ring and including Faraday shielding means surrounding said brush means.

4. A high voltage slip ring assembly adapted to be filled with an insulating fluid comprising:

a rotor and a stator for defining a cavity therebetween, seal means operatively sealing said cavity for retaining the insulating fluid therein, said rotor and said stator being at ground potential, anode coupling means within said cavity, a plurality of cathode coupling means within said cavity, said anode coupling means including Faraday shielding means, said plurality of cathode coupling means including Faraday shielding means, a portion of said plurality of cathode coupling means encased in a semi-conductive material for dispersing charge build-up among said cathode coupling means, and dielectric barrier means within said cavity for blocking line of sight particulate paths when the slip ring assembly is transferring power between said anode coupling means and said rotor and said stator, between said plurality of cathode coupling means and said rotor and said stator, and between said anode coupling means and said plurality of cathode coupling means, whereby operational short circuiting and arcing within said cavity is prevented.

5. A high voltage slip ring assembly adapted to be filled with an insulating fluid comprising:

a stator, a rotor rotatably mounted to said stator defining a cavity therebetween, seal means operatively sealing said cavity for retaining insulating fluid therein, said rotor including an end mounting plate having an anode junction box and cathode junction box selectively positioned thereon, said stator including an anode receptacle and a cathode receptacle, said cavity having wall portions which remain at ground potential, anode coupling means for coupling a positive potential from said anode receptacle through said cavity to said anode junction box, and cathode coupling means for coupling a plurality of negative potentials from said cathode receptacle through said cavity to said cathode junction box, said anode and cathode coupling means each including Faraday shielding means, a portion of said cathode coupling means encased in a semi-conductive material for dispersing charge build-up among said plurality of negative potentials, and dielectric barrier means within said cavity for blocking line of sight particulate paths between the conductive parts which are at substantially different potentials when the slip ring assembly is transferring power, whereby, when said cavity is filled with the insulating fluid, the electrical integrity of the slip ring assembly is maintained.

6. A high voltage slip ring assembly according to claim 5, wherein, said anode coupling means comprises:

an anode conductive ring mounted in said cavity on said rotor, anode conductor means for electrically coupling said anode ring to said anode junction box, and an anode brush block assembly extending from said anode receptacle into said cavity including brush means for sliding electrical contact with said anode ring and including Faraday shielding means surrounding said brush means, and said cathode coupling means comprises:

a plurality of cathode conductive rings mounted on said rotor within said cavity, a plurality of cathode conductor means, each for electrically coupling one of said cathode rings to said cathode junction box, and a plurality of cathode brush assemblies extending from said cathode receptacle into said cavity and surrounded by a Faraday shield housing, each of said cathode brush assemblies including brush means for sliding electrical contact with one of said cathode rings.

7. A high voltage slip ring assembly according to claim 1, 3, 4 or 6, wherein the dielectric constant of said dielectric barriers is substantially equal to the dielectric constant of the insulating fluid.

8. A high voltage slip ring assembly according to claim 7, which additionally includes a central bore selectively sized to permit a patient to be positioned therein whereby the slip ring assembly may be used in a computerized axial tomography system to couple power to an orbiting X-ray tube.

9. A high voltage slip ring assembly according to claim 7, wherein the dielectric barrier means include dielectric barriers with selective grooves to increase the length of voltage surface creepage paths.

10. A high voltage slip ring assembly according to claim 7, wherein the anode and cathode coupling means are comprised of elements having rounded features.

* * * * *